US005299954A

United States Patent [19]

Ishii

[11] Patent Number: 5,299,954

[45] Date of Patent: Apr. 5, 1994

[54] TERMINAL CONNECTING STRUCTURE FOR A FLAT CIRCUIT BODY

[75] Inventor: Takashi Ishii, Shizuoka, Japan

[73] Assignee: Yazaki Corporation, Tokyo, Japan

[21] Appl. No.: 964,296

[22] Filed: Oct. 21, 1992

[30] Foreign Application Priority Data

Oct. 22, 1991 [JP] Japan ..... 3-086006[U]

[51] Int. Cl.[5] ..... H01R 13/00

[52] U.S. Cl. ..... 439/422

[58] Field of Search ..... 439/421, 422, 426, 492–499

[56] References Cited

U.S. PATENT DOCUMENTS 3,247,316 4/1966 Weimer, Jr. ..... 439/422
4,560,224 12/1985 Weisenburger ..... 439/422
4,938,713 7/1990 Daly et al. ..... 439/422

*Primary Examiner*—Joseph H. McGlynn
*Attorney, Agent, or Firm*—Sughrue, Mion, Zinn, Macpeak & Seas

[57] ABSTRACT

A terminal connecting structure securing and retaining a holding tongue of the terminal for connecting at a conductive end portion of the flat circuit body, the terminal connecting structure is provided with a covering plate retaining the terminal, the covering plate includes notched portions for engaging with the holding tongue at end of the flat circuit body.

16 Claims, 4 Drawing Sheets

TERMINAL CONNECTING STRUCTURE FOR A FLAT CIRCUIT BODY

BACKGROUND OF THE INVENTION

The present invention relates to a terminal connecting structure for connecting a terminal to a conductive end portion of a flat circuit body.

FIG. 6 is a perspective view illustrating a conventional terminal connecting structure for a flat circuit body disclosed in Unexamined Japanese Utility Model Publication (OPI) No. Sho. 63-73862. FIG. 7 is a transverse cross-sectional view taken along an arrow C—C in FIG. 6. This structure is of a type in which a holding tongue 28 of a terminal 27 is secured and retained onto a conductive end portion 26*a* of the flat circuit body 25 such as a flat cable or the like. The flat circuit body 25 is provided with a plurality of circuit conductors 26 arranged in parallel and disposed between an upper and lower insulative sheets 29 and 30. The conductive end portion 26*a* exposes on the lower sheet 30.

On the other hand, the terminal 27 is provided with an electrical connecting portion 31 formed at an end thereof for connecting portion 31 formed at an end thereof for connecting to a mating male connector not shown in the figures, and a retaining tongue 32 and the holding tongue 28 provided at the other end thereof to face each other. The holding tongue 28 is swingable along a base portion 28*a* acting as a fulcrum. A pair of claw portions 33 are unitary formed on the both sides of an end portion of the holding tongue 28 for binding the retaining tongue 32.

Thus, the conductive end portion 26*a* is held between the holding tongue 28 and retaining tongue 32, as shown in FIG. 7, and the pair of claw portions 33 of the holding tongue 28 penetrate through the insulative sheets 29 and 30 and bend to hold the retaining tongue 32, so that the terminal 27 is provisionally retained. Further the holding tongue 28 and a center portion of the retaining tongue 32 are welded into the conductive end portion 26*a* with a spot welding 34, thereby to completely retain the terminal 27.

However, in the above conventional structure, the holding tongue 28 of the terminal 27 projects in a width direction thereof, when a pitch P between the adjacent terminals 27' is designed to be short, the insulation therebetween may deteriorate. Accordingly, a problem may result in that it would be difficult to arrange the circuit conductor 26 with high-density. Further, in the provisionally retained condition of the terminal 27, the terminal 27 may pivotally slide in a width direction (direction of an arrow A—A shown in FIG. 6) along the claw portions 33 acting as a fulcrum. Therefore, there would also cause a problem in undesirably contacting the adjacent terminals 27' after being completely retained.

SUMMARY OF THE INVENTION

With the above problems accompanying the conventional terminal connecting structure in view, it is an object of the present invention to provide a terminal connecting structure for a flat circuit body in which the circuit conductor can be arranged with high-density, and a terminal is prevented from pivotally sliding in the width direction.

To achieve the above object, according to the present invention, there is provided a terminal connecting structure for securing and retaining a holding tongue of the terminal onto a conductive end portion of a flat circuit body, characterized in that the terminal connecting structure is provided with a covering plate includes notched portions for engaging with the holding tongue of the terminal.

According to the present invention, since the covering plate retains the terminal by holding the holding tongue of the terminal between the conductive end portion and the plate, the claw portions for binding the retaining tongue is not required contrary to the conventional structure, and accordingly, the circuit conductor can be arranged with high-density. Further, since the holding tongue of the terminal engages with the notched portion of the covering plate, the terminal is prevented from pivotally sliding in a width direction of the flat circuit, thereby avoiding the adjacent terminals to undesirably contact to each other.

BRIEF DESCRIPTION OF THE DRAWINGS

In the accompanying drawings.

DESCRIPTION OF THE PREFERRED EMBODIMENTS

Figure 1:
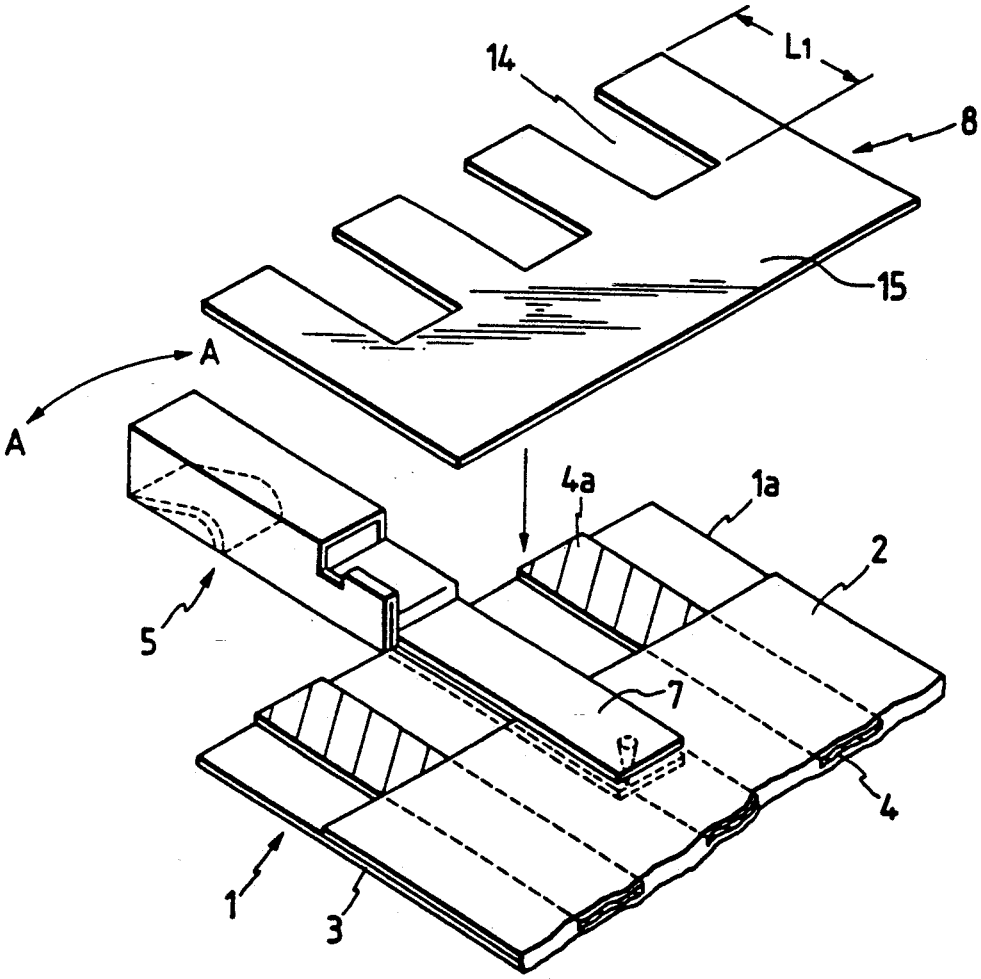
FIG. 1 is an exploded perspective view showing a first embodiment of a terminal connecting structure for a flat circuit body according to the present invention in provisionally retained condition.
Figure 2:
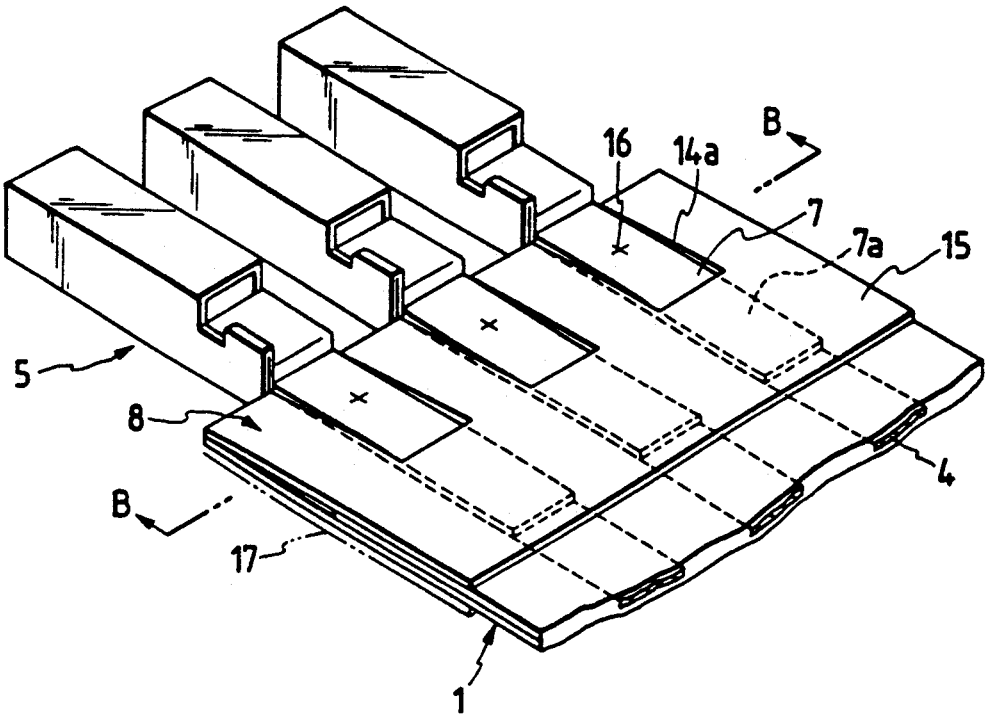
FIG. 2 is a perspective view of the terminal connecting structure for the flat circuit body shown in FIG. 1 in a completely retained condition.

FIG. 1 is an exploded perspective view showing a first embodiment of a terminal connecting structure for a flat circuit body according to the present invention in provisionally retained condition. FIG. 2 is a perspective view of the terminal connecting structure for the flat circuit body in a completely retained condition.

As shown in these figures, a flat circuit body 1 is provided with a plurality of circuit conductors 4 arranged in parallel between upper and lower insulative sheets 2 and 3. A terminal 5 is provided with a holding tongue 7 for holding a conductive end portion 4*a* exposed on the lower sheet 3. A covering plate 8, which is made of an insulative resin, is adhered on an end portion 1*a* of the flat circuit body 1, thereby provisionally retaining the terminal 5.

Figure 3:
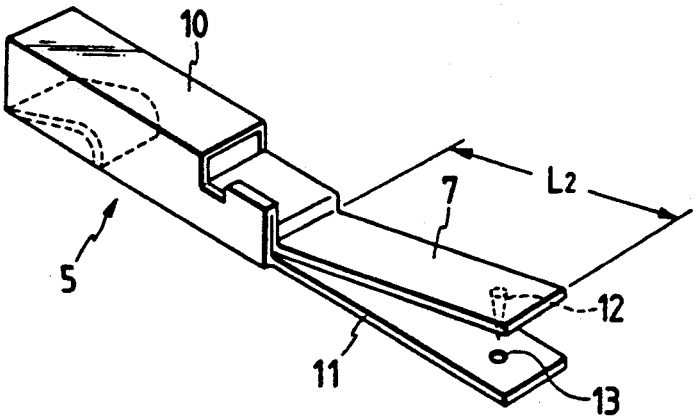
FIG. 3 is an enlarged perspective view of a terminal according to the present invention.

As shown in FIG. 3, in the terminal 5, an electrical connecting portion 10 is formed at an end of the terminal 5 to correspond to a mating male connector (not shown), and a retaining tongue 11 and the holding tongue 7 are provided at the other end thereof to face each other, a sharp pin portion 12 is disposed on an end of the holding 7 for the provisional retaining, an inserting hole 13 is provided on the retaining tongue 11 at a position corresponding to the pin portion 12.

The holding tongue 7 and retaining tongue 11 are designed to be longer than the length of the exposing conductive end portion 4a, and hold the conductive end portion 4a of the flat circuit body 1 therebetween, while an end of the pin portion 12 penetrates through the upper insulative sheet 2, conductive portion 4 and lower insulative sheet 3 and inserts into the inserting hole 13, so that the terminal 5 is provisionally connected. In this condition, the terminal 5 is prevented from pivotally sliding in a width direction (direction of an arrow A—A in FIG. 1) owing to the pin portion 12 acting as a fulcrum. The covering plate 8 is utilized to retain the terminal 5 provisionally.

Figure 4:
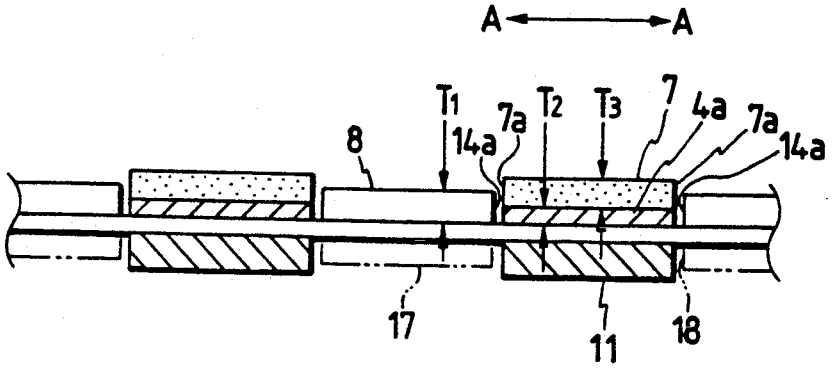
FIG. 4 is a transverse cross-sectional view taken along an arrow B—B in FIG. 2.

In the covering plate 8, notched portions 14 for engaging with the holding tongue 7, which are relatedly wide and have rectangular shape corresponding to the holding tongue 7 of the terminal 5, are provided at an end of an insulative resin plate. A length $L_1$ of the notched portion 14 is designed to be shorter than a length $L_2$ of the holding tongue 7, so that a base portion 15 of the covering plate 8 presses on an end of the holding tongue 7. Further, the height of the notched portion 14, that is, the plate thickness $T_1$ of the covering plate 8 is designed to be equal to or greater than the sum of a thickness $T_2$ of the conductive end portion 4a and a half of a thickness $T_3$ of the holding tongue 7 as shown in FIG. 4 (cross-sectional view in FIG. 2), so that a side surface 7a of the holding tongue 7 contacts a respective side surface 14a of the notched portion 14. Therefore the terminal is prevented from pivotally sliding in a width direction (direction of an arrow A—A in FIG. 1). Thus, the terminal 5 is completely retained by a spot welding 16 onto a center of the holding tongue 7.

Moreover, another covering plate 17 may also be adhered on a back surface of the flat circuit body 1. A notched portion 18 is so provided as to correspond to the retaining tongue 11 of the terminal 5, so that the terminal 5 can be more firmly retained provisionally. In adhering the covering plates 8 and 17, which are made of polyester and so on, it is preferably to use a thermosetting adhesive which firmly bonds by heating. Moreover, it is not always necessary to provide the pin portion 12 of the terminal 5 for provisionally connecting.

Figure 5:
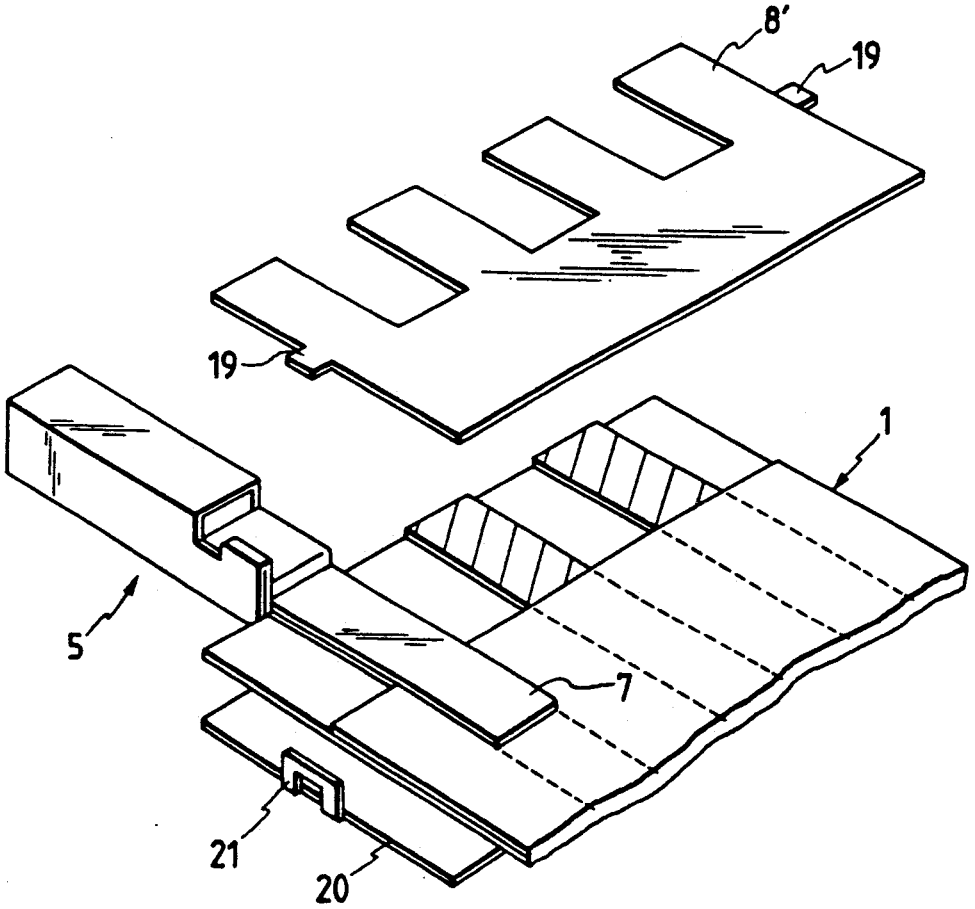
FIG. 5 is a perspective view showing second embodiment of a terminal connecting structure of the flat circuit body in the provisionally retained condition.
Figure 6:
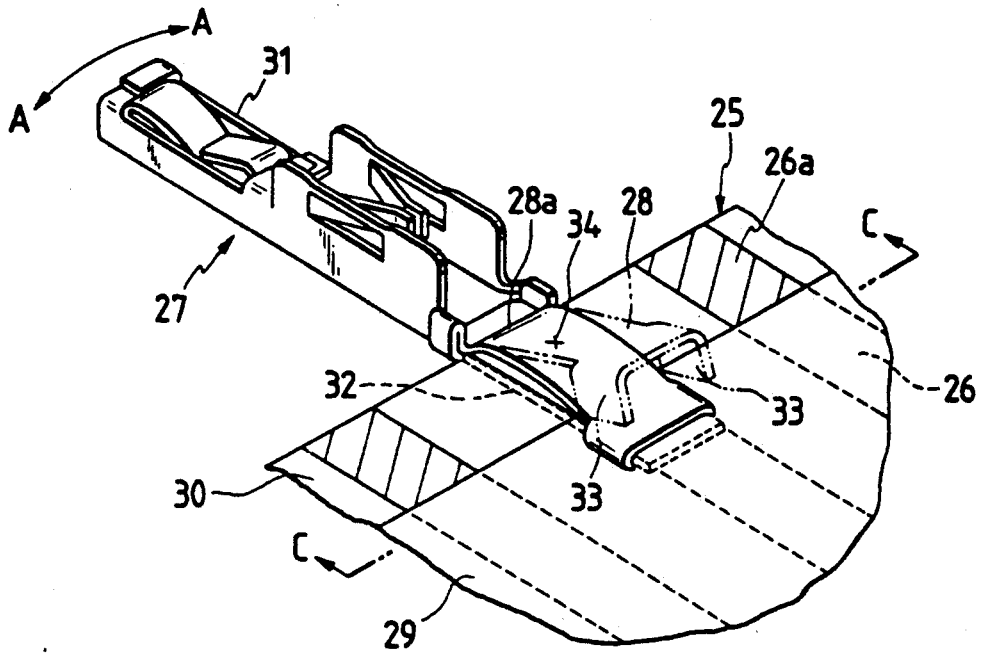
FIG. 6 PRIOR ART
FIG. 6 is a perspective view illustrating a conventional terminal connecting structure for the flat circuit body.
Figure 7:
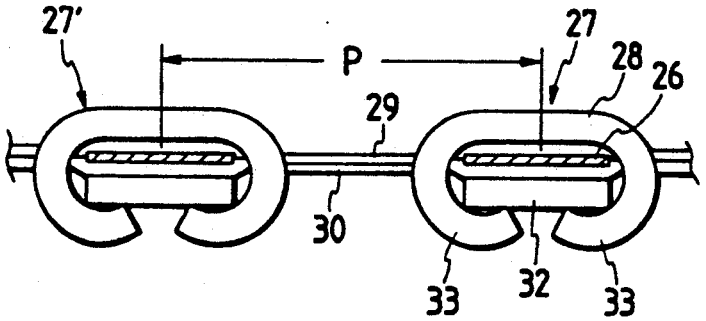
FIG. 7 PRIOR ART
FIG. 7 is a transverse cross-sectional view taken along an arrow C—C in FIG. 6.

FIG. 5 shows a second embodiment of the present invention, in which retaining projections 19 are provided on both the sides of the covering plate 8' to correspond to the holding tongue 7 of the terminal 5, an engagement flame tongue 21 corresponding to the retaining projection 19 is provided on a covering plate 20 disposing on a back side of the flat circuit body 1, and both the covering plates 8' and 20 hold the flat circuit body 1 therebetween without using an adhesive. In this embodiment, although the notched portion 18 is not provided on the back side of the covering plate 20 as in the first embodiment, the notched portion 18 may be provided.

As described above, according to the present invention, since the terminal is provisionally retained with the covering plate, the conventional claw portions for binding the retaining tongue is not required, which claws projects in a width direction, and accordingly, the circuit conductor can be arranged with high-density. Further, the holding tongue of the terminal engages with the notched portion of the covering plate, so that the terminal is prevented from pivotally sliding in a width direction. Therefore, the terminal connecting structure of the present invention does not suffer from a problem in undesirably contacting the adjacent terminals to one another, which problem may conventionally arise during inserting into the mating terminal.

What is claimed is:

1. A terminal connecting structure conductors arranged in parallel;

a plurality of terminals comprising first and second holding members for respectively holding said conductors of said flat circuit body therebetween so as to electrically connect said conductors to said terminals; and a covering plate including a base portion and a plurality of engaging portions, said base portion abutting against a portion of said first holding members of said terminals and said engaging portions being respectively interlocked between adjacent first holding members, thereby provisionally retaining said terminal onto said first circuit body.

2. The terminal connecting structure of claim 1, wherein a length of said engaging portions is shorter than that of said first holding members.

3. The terminal connecting structure of claim 1, wherein a thickness of said first covering plate is equal to or thicker than a sum of a thickness of said flat circuit body and a half thickness of said first holding members.

4. The terminal connecting structure of claim 1, wherein each of said first holding members includes a pin, and each of said second holding members has an inserting hole corresponding to said pin, said pin penetrating through said flat circuit body and into said inserting hole.

5. The terminal connecting structure of claim 1, wherein said terminal is completely retained by welding said terminal to each of said first holding members.

6. The terminal connecting structure of claim 1, wherein said first covering plate comprises an insulative resin plate.

7. The terminal connecting structure of claim 1, wherein said first covering plate is adhered on a surface of said flat circuit body with a thermosetting adhesive which bonds by heating.

8. The terminal connecting structure of claim 1, further comprising a second covering plate, wherein both of said first and second covering plates hold said flat circuit body therebetween.

9. The terminal connecting structure of claim 8, wherein said second covering plate comprises a plurality of engaging portions for engaging with said second holding member of said terminal.

10. The terminal connecting structure of claim 8, wherein said first covering plate comprises at least a pair of projections formed on both sides thereof, and said second covering plate comprises at least a pair of engagement member on both sides thereof for engaging with said respective projection, thereby retaining both said covering plates onto said flat circuit body therebetween.

11. The terminal connecting structure of claim 8, wherein said second covering plate comprises an insulative resin plate.

12. The terminal connecting structure of claim 8, wherein said second covering plate is adhered on a surface of said flat circuit body with a thermosetting adhesive which bonds by heating.

13. The terminal connecting structure of claim 1, wherein said covering plate includes a base portion and a plurality of arm portions extending from said base portion and separated by notched portions, said base portion abutting against said first holding members and said arm portions being provided between adjacent first holding members with said first holding members being at least partially received in said notched portions.

14. The terminal connecting structure of claim 13, wherein a length of said arm portions is shorter than the length of said first holding members.

15. The terminal connecting structure of claim 13, wherein the thickness $T_p$ of said first covering plate is defined by the equation:

$$T_p \geqq T_{CB} + \tfrac{1}{2} * T_{1st\ hm},$$

where $T_{CB}$ corresponds to the thickness of the circuit body and $T_{1st\ HM}$ corresponds to the thickness of said first holding member.

16. A terminal connecting structure, comprising:

a flat circuit body including a plurality of conductors arranged in parallel and spaced from each other;

a plurality of terminals corresponding in number to said plurality of conductors, each of said terminals including first and second holding members for respectively sandwiching said conductors therebetween; and a covering plate provided in contact with said first holding member of each of said terminals so as to retain said conductors sandwiched between said first and second holding members.

* * * * *